US006311535B1

(12) United States Patent
Mehta

(10) Patent No.: US 6,311,535 B1
(45) Date of Patent: Nov. 6, 2001

(54) HIGH VOLTAGE BUSHING EMBOSSING PUNCH TOOL AND METHOD

(75) Inventor: Tarak Mehta, Cary, NC (US)

(73) Assignee: Abb T&D Technology Ltd., Zurich (CH)

( * ) Notice: Subject to any disclaimer, the term of this patent is extended or adjusted under 35 U.S.C. 154(b) by 0 days.

(21) Appl. No.: 09/473,875

(22) Filed: Dec. 28, 1999

(51) Int. Cl.[7] ..... B21D 28/26
(52) U.S. Cl. ..... 72/334; 72/327
(58) Field of Search ..... 72/334, 333, 327, 72/326, 294, 379.2; 29/896.6

(56) References Cited

U.S. PATENT DOCUMENTS 1,642,166 * 9/1927 McCaffrey .
2,432,804 * 12/1947 Rieske .
3,442,110 * 5/1969 Walton .
4,356,717 * 11/1982 Okunishi ..... 72/342
6,101,859 * 8/2000 Shieh ..... 72/327

FOREIGN PATENT DOCUMENTS

28087 * 3/1977 (JP) ..... 72/334
311800 * 12/1989 (JP) ..... 72/334

* cited by examiner

*Primary Examiner*—Daniel C. Crane
(74) *Attorney, Agent, or Firm*—Woodcock Washburn Kurtz Mackiewicz & Norris

(57) ABSTRACT

The present invention provides a method and system that creates a hole with an embossed base in a planar sheet. The system comprises an embossing punch that forms a raised area in the planar sheet, a hole punch coupled to the embossing punch that forms a hole in the planar sheet, and a surface for holding the planar sheet. The surface has an aperture that permits the hole punch and the embossing punch to pass through the surface and contact the planar sheet.

14 Claims, 2 Drawing Sheets

HIGH VOLTAGE BUSHING EMBOSSING PUNCH TOOL AND METHOD

FIELD OF THE INVENTION

This invention relates to a system for automatically embossing and creating a hole in a workpiece. More specifically, the present invention relates to making a hole with an embossed base for accommodating high voltage bushings in transformer tank enclosures.

BACKGROUND OF THE INVENTION

Due to the very nature of their operation, power system transformers must manage high voltage levels. For example, distribution transformers commonly reduce transmission voltages from distribution levels of 2.3 kV to 69 kV down to final utilization levels of 120V to 480V. In so doing, power system transformers use high voltage bushings to input the distribution level voltages. The high voltage bushings are attached to the primary windings of the transformer. Because the transformer windings reside in oil-filled tanks, the high voltage bushings commonly are affixed to the outside of oil-filled transformer tanks. The high voltage bushings are then connected to the primary windings through holes in the transformer tank. In the case of pad-mounted transformers, the oil-filled tanks and high voltage bushings are further surrounded by an outside enclosure for safety reasons.

In order to protect the transformer and protect the public from electrical hazards, the high voltage bushings are sized in accordance with strict industry standards. Accordingly, the corresponding holes made in the transformer tanks must be within strict tolerances. If the holes are out of tolerance, the standard sized high voltage bushings may be too large for the holes, rendering the tank unusable. Alternatively, the holes may be too large for the high voltage bushings, permitting water damage to the transformer and safety concerns for the public.

Manufacturing a pad-mounted transformer tank begins by making holes for the high voltage bushings in flat sheets of metal. The flat metal sheets eventually are formed into rectangular enclosures. The process of making holes for the high voltage bushings in pad-mounted distribution transformers is further complicated by an industry-accepted standard that requires each hole to have a circular raised base, formed at a twelve degree angle with the enclosure. In other words, before punching a hole in the metal sheet, the sheet must have a circular deformation that forms a twelve-degree angle with the rest of the metal sheet. Offsetting the high voltage bushing at twelve degrees permits easier installation and allows the high voltage bushing to use less space in the entire pad-mounted transformer enclosure.

A process called embossing is used to make the circular, raised deformation. Embossing is a process by which metal is lifted and deformed. Either before or after the metal sheet is embossed, a hole is punched such that the embossed portion forms a circular base around the punched hole. FIGS. 1A and 1B show one example of a prior art embossing and hole punching process 100. In FIG. 1A, an embossing machine 101 embosses a metal sheet 104 by deforming 105 one side of metal sheet 104 with an embossing punch 103, without causing, a hole. In order to meet the requirements for a high voltage bushing (not shown), embossing punch 103 has an angled punch head 107 at an angle $\alpha$. Angled punch head 107 creates an angle $\beta$ in metal sheet 104. In accordance with industry standards for high voltage bushings, angles $\alpha$ and $\beta$ commonly are set at twelve degrees.

An operator then removes embossed metal sheet 104 from embossing machine 101 and places it in a hole-punching machine 110. As shown in FIG. 1B, hole-punching machine 110 has a hole punch 102 with a flat punch head 108. Hole punch 102 also has a radius r2 that is less than a radius r1 of embossing punch 103. The smaller radius r2 forms a hole 106 with an embossed base raised at an angle of twelve degrees, as required in the transformer industry.

In order to punch a sufficiently round hole, the operator must rotate metal sheet 104 twelve degrees in a counterclockwise direction. The twelve-degree rotation permits hole-punching machine 110 to make a sufficiently circular hole to meet the strict industry standards. In addition, in order to ensure that a precision hole is formed, embossed portion 105 must be placed directly under hole punch 102. Thus, in order to keep the radius of punched hole 106 within the specified tolerance, the machine operator must carefully align hole punch 102 over deformation 105 made by the embossing punch 103. The further hole punch 102 is out of alignment with the deformation 105, the more out of tolerance hole 106 will be. However, visually aligning deformation 105 with hole punch 102 is a difficult and imprecise process. Moreover, once the operator aligns hole punch 102, metal sheet 104 may move while the operator is securing it to hole punch machine 110. Accordingly, it often takes many attempts and many unusable metal sheets to create a hole within the strict tolerance required for transformer enclosures. Although there are laser-cutting devices that can create holes within the required tolerance, these devices are far more complex and more costly.

Therefore, it would be advantageous to provide a system and method that would remove the need for human intervention and eliminate the error inherent in aligning an embossed metal sheet with a hole punch. In addition, by removing human intervention, the embossing and punching process may be automated using robots. However, current robotic technology is incapable of rotating metal sheet 104 twelve degrees in a counterclockwise direction as required in prior art process 100. Automating this process may also contribute to the robotic automation of an entire manufacturing or assembly line process.

SUMMARY OF THE INVENTION

The present invention provides a method and system that creates a hole with an embossed base in a planar sheet. The system comprises an embossing punch that forms a raised area in the planar sheet, a hole punch coupled to the embossing punch that forms a hole in the planar sheet, and a surface for holding the planar sheet. The surface has an aperture that permits the hole punch and the embossing punch to pass through the surface and contact the planar sheet.

In one embodiment, the embossing punch and the hole punch have angled heads whose angles are approximately equal, so that a hole formed in the raised area is circular. Other aspects of the present invention are disclosed below.

Reference will now be made in detail to a presently preferred embodiment of the invention, an example of which is illustrated in the accompanying drawings.

DETAILED DESCRIPTION OF PREFERRED EMBODIMENTS

The present invention provides a single device that automatically embosses and punches a hole in a metal sheet without the need for human intervention, and thus is capable of producing holes within the strict tolerances required by transformer enclosures, for example. The present invention also provides a cost advantage by having one machine perform a function that in the past required two machines.

Figure 1B:
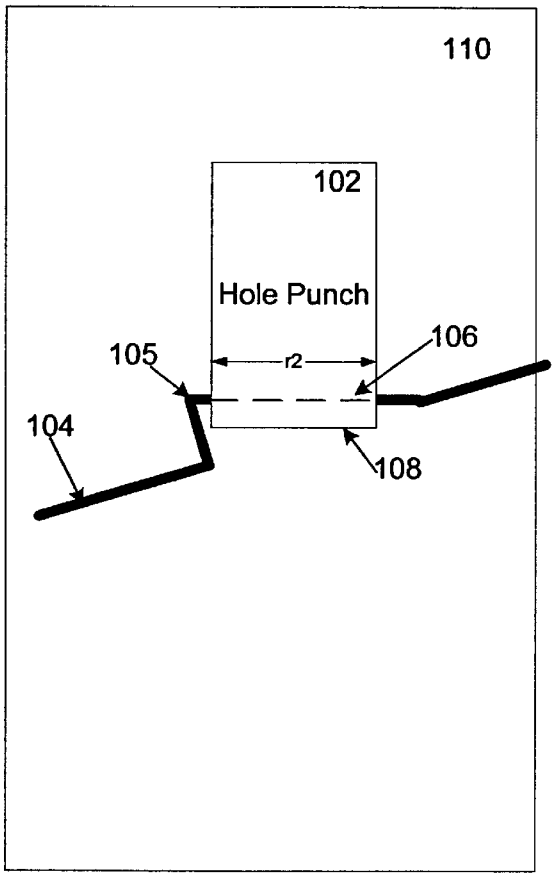
FIGURE 1B ( PRIOR ART )
FIGS. 1A and 1B show a prior art embossing and hole punching process.
Figure 1A:
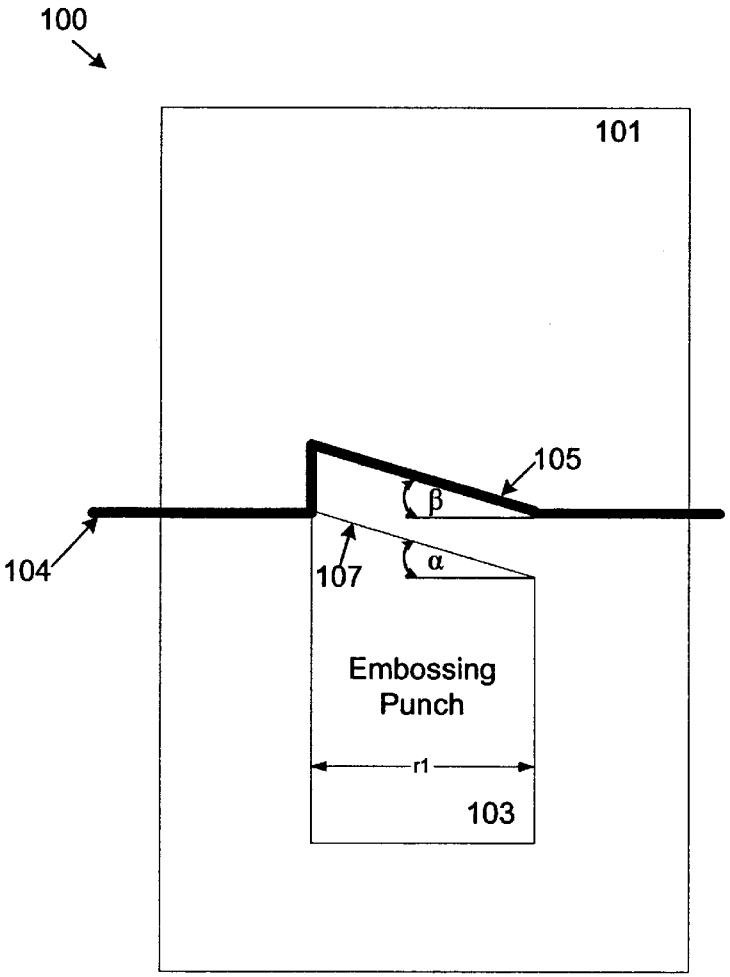
FIGURE 1A ( PRIOR ART)
Figure 2B:
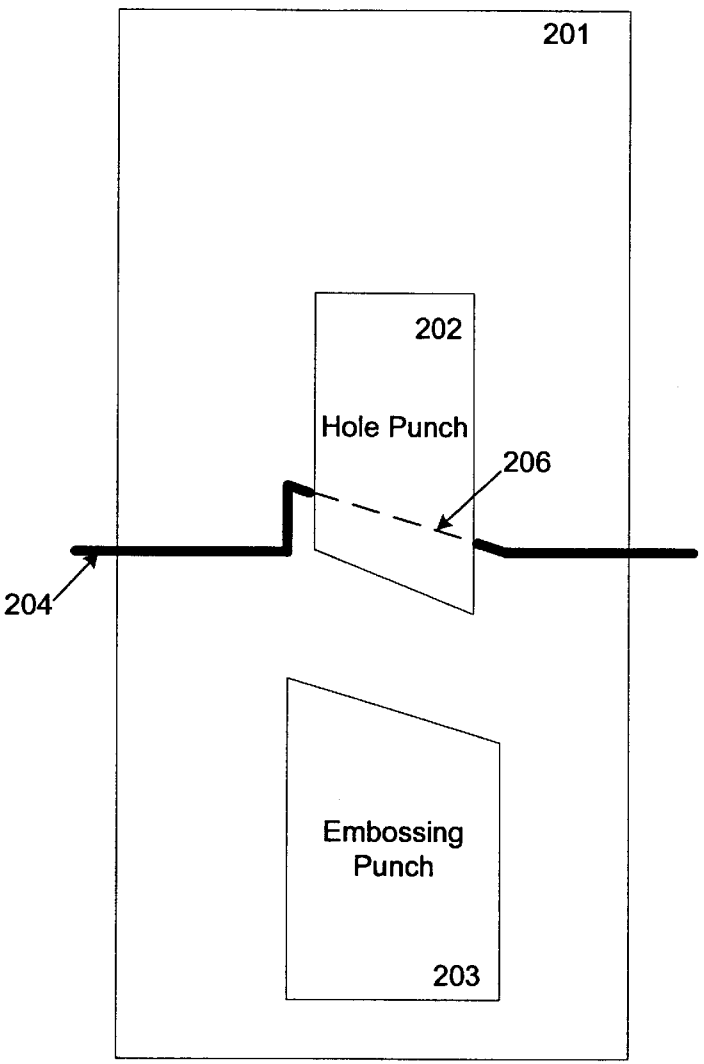
FIGS. 2A and 2B show an embossing and hole punching process, according to the present invention.
Figure 2A:
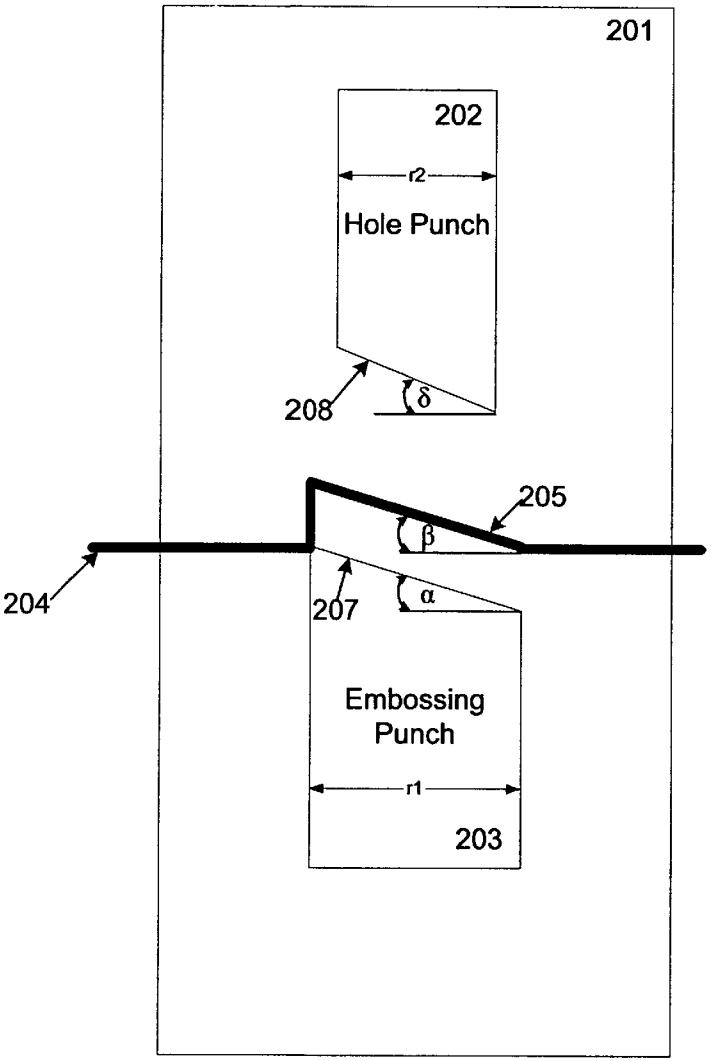

FIGS. 2A and 2B show two phases of a single machine 201 that first embosses a metal sheet 204 and then punches a hole 206 into the embossed portion 205. FIGS. 2A and 2B show a side view of metal sheet 204. Metal sheet 204, which may be made of mild or stainless steel, is placed in machine 201. Metal sheet 204 may be placed in machine 201 by robotic techniques, for example. Machine 201 has special grip pads (not shown) to control the movement of metal sheet 204 in order to minimize distortion, tearing and thinning of the steel during the process.

As shown in FIG. 2A, embossing punch 203 first moves upward, creating a deformation 205 in metal sheet 204. Because embossing punch 203 has an embossing head 207 with an angle $\alpha$, deformation 205 creates an angle $\beta$ with the undeformed portion of metal sheet 204, where angle $\beta$ equals angle $\alpha$. Where the resultant hole is for a high voltage bushing on a transformer enclosure, angles $\alpha$ and $\beta$ preferably will be about twelve degrees. Embossing punch 203 and hole punch 202 are synchronized so that as embossing punch 203 travels up and toward metal sheet 204, hole punch 202 travels upward and away from metal sheet 204. As shown in FIG. 2B, after embossing punch 203 has created deformation 205 in metal sheet 204, hole punch 202 travels down and toward metal sheet 204.

As with embossing punch 203, hole punch 202 has a punching head 208 with an angle $\delta$. It is preferred that angle $\delta$ is equal to angles $\alpha$ and $\beta$. More preferably, angles $\delta$, $\alpha$ and $\beta$ are twelve degrees. By making angle $\delta$ equal to angles $\alpha$ and $\beta$, resultant hole 206 is circular, thus keeping hole 206 within the strict tolerances required for transformer enclosures, for example. After hole punch 202 creates hole 206 in metal sheet 204, hole punch moves upward and away from metal sheet 204, until neither hole punch 202 nor embossing punch 203 are engaging metal sheet 204. Metal sheet 204 is then removed from machine 201 for further processing, allowing another sheet (not shown) to enter machine 201 and undergo the embossing and punching process, similar to metal sheet 204. Metal sheet 204 may be removed from machine 201 by robotic techniques, for example.

The present invention is directed to parts and apparatuses used in the automated fabrication of large metal enclosures, that include, but are not limited to, electrical transformer tank enclosures, regardless of any specific description in the drawing or examples set forth herein. It will be understood that the present invention is not limited to use of any of the particular parts or assemblies discussed herein. Indeed, this invention can be used in any assembly or manufacturing line that requires automated embossing and hole punching. Further, the apparatus disclosed in the present invention can be used with the method of the present invention or a variety of other applications.

While the present invention has been particularly shown and described with reference to the presently preferred embodiments thereof, it will be understood by those skilled in the art that the invention is not limited to the embodiments specifically disclosed herein. Those skilled in the art will appreciate that various changes and adaptations of the present invention may be made in the form and details of these embodiments without departing from the true spirit and scope of the invention as defined by the following claims.

I claim:

1. A system that creates a hole with an embossed base in a planar sheet, comprising:

a hole punch;

an embossing punch coupled to said hole punch, wherein said embossing punch forms a raised area with an angled portion at an angle to said planar sheet, and wherein said hole punch forms a hole in said angled portion of said raised area; and a surface for holding said planar sheet, wherein said surface has an aperture that permits said hole punch and said embossing punch to pass through said surface and contact said planar sheet.

2. The system of claim 1, wherein said embossing punch has an angled head, and wherein said hole punch has an angled head.

3. The system of claim 2, wherein said angled head of said embossing punch and said angled head of said hole punch are approximately equal.

4. The system of claim 1, wherein said raised area and said hole are circular.

5. The system of claim 1, wherein said hole punch and said embossing punch move in a vertical plane relative to each other.

6. The system of claim 1, wherein said planar sheet includes a metal substance.

7. A method for creating a hole with an embossed base in a planar sheet, comprising the steps of:

holding said planar sheet in a fixed position;

forming a raised area with an angled portion in said planar sheet; and creating a hole in said planar sheet, wherein said hole is formed in said angled portion of said raised area.

8. The method of claim 7, wherein said raised area and said hole are circular.

9. The method of claim 7, wherein said planar sheet includes a metal substance.

10. The method of claim 7, wherein said forming said raised area and said creating said hole are done in synchronization.

11. The method of claim 10, wherein said synchronization is accomplished electrically.

12. A system that creates a hole with an embossed base in a planar sheet, comprising an embossing punch with an angled head that forms a raised area with an angled portion at an angle to said planar sheet, a hole punch with an angled head that forms a hole in said angled portion of said raised area, wherein said embossing punch and said hole punch move in a vertical plane relative to each other, said system further comprising a surface for holding said planar sheet, wherein said surface has an aperture that permits said hole punch and said embossing punch to pass through said surface and contact said planar sheet.

13. The system of claim 12, wherein said angled head of said said embossing punch and said angled head of said hole punch are approxiamtely equal.

14. The system of claim 12, wherein said planar sheet includes a metal substance.

* * * * *

UNITED STATES PATENT AND TRADEMARK OFFICE

CERTIFICATE OF CORRECTION

PATENT NO. : 6,311,535 B1
DATED : November 6, 2001
INVENTOR(S) : Tarak Mehta

It is certified that error appears in the above-identified patent and that said Letters Patent is hereby corrected as shown below:

Column 4,
Lines 35-39 should read as follows:

-- holding said planar sheet in a fixed position;
forming a raised area with an angled portion at an angle to said planar sheet while being held in said fixed position; and
creating a hole in said planar sheet, wherein said hole is formed in said angled portion of said raised area while being held in said fixed position. --

Signed and Sealed this

Second Day of July, 2002

*Attest:*

*Attesting Officer*

JAMES E. ROGAN
*Director of the United States Patent and Trademark Office*